United States Patent [19]

Maryyanek et al.

[11] Patent Number: 4,600,002

[45] Date of Patent: Jul. 15, 1986

[54] DISPOSABLE RESPIRATOR

[75] Inventors: Richard D. Maryyanek, Northbridge; Joseph Z. Zdrok, Webster, both of Mass.

[73] Assignee: American Optical Corporation, Southbridge, Mass.

[21] Appl. No.: 664,374

[22] Filed: Oct. 24, 1984

[51] Int. Cl.[4] ..... A62B 7/10

[52] U.S. Cl. ..... 128/206.19

[58] Field of Search ..... 128/206.19, 205.28, 128/205.29

[56] References Cited

U.S. PATENT DOCUMENTS

| | | | |
|---|---|---|---|
| 248,497 | 7/1978 | Slosek . | |
| 249,072 | 8/1978 | Revoir . | |
| 2,787,264 | 4/1957 | Thiebault et al. | 128/206.19 |
| 3,521,630 | 7/1970 | Westberg et al. | 128/146.6 |
| 4,248,220 | 2/1981 | White | 128/206.16 |
| 4,454,881 | 6/1984 | Huber et al. | 128/206.19 |

FOREIGN PATENT DOCUMENTS

| | | | |
|---|---|---|---|
| 5104 | of 1913 | United Kingdom | 128/206.19 |
| 842766 | 7/1960 | United Kingdom | 128/206.19 |
| 1588442 | 4/1981 | United Kingdom . | |
| 2103491 | 2/1983 | United Kingdom | 128/206.19 |

*Primary Examiner*—Henry J. Recla

*Attorney, Agent, or Firm*—Pahl, Lorusso & Loud

[57] ABSTRACT

A multiple ply, fold-flat, disposable respirator having, as one ply, a layer of a toxic gas or vapor absorbing material. Another ply is an aerosol filter. The respirator has an inturned vertical seam covered with a strip of foamed elastomer.

7 Claims, 5 Drawing Figures

DISPOSABLE RESPIRATOR

BACKGROUND OF THE INVENTION

1. Field of the Invention

This invention relates to disposable respirators more particularly of the fold-flat type.

2. Description of the Prior Art

It is important to seek the protection of one's respiratory system with a respirator when subjected to unpleasant or noxious environments. However, respirator wearing comfort, convenience of carrying and freedom from maintenance are paramount to overcoming the commonly encountered resistance to use.

In addition to a further desire for compactness, lightness of weight and comfort of face fit, a wearer's ready acceptance of a particular respirator design requires minimal resistance to breathing through the face piece and avoidance of heretofore encountered "hot and clammy" breathing atmosphere within the face piece. This, in turn, requires adequate spacing of the face piece around nose and mouth and avoidance of collapse during inhalation.

Heretofore, the above has been best attended to with rigidly cupped and/or frame supported respirator structures of types exemplified by U.S. Pat. Nos. Des. 248,497 and 3,521,630. These, however, suffer the disadvantages of costly manufacture, ungainliness in storage and carrying by workers as well as a vulnerability to damage by crushing, particularly in the case of the type of structure illustrated in U.S. Pat. No. Des. 248,497. Frame supported structures, on the other hand, require periodic cleaning of the support structure, tedious filter replacement and provision for clean storage of the devices between times of use.

In view of the above, the more easily carried fold-flat type disposable pocket respirator is attractive to workers and suppliers alike. However, such devices, of which those of U.K. Pat. No. 1,588,442 and U.S. Pat. Nos. Des. 249,072 and 4,248,220 are exemplary, lack the ease of application to the face and conformity to the face provided by the more conventional rigid cup-formed and frame-supported devices. The ability to conform to the shape of the face provides both comfort and a good seal with the face, around the periphery of the respirator. In particular, the device of U.K. Pat. No. 1,588,442 has a horizontal seam which terminates in corners which contact the face in a manner detrimental both to comfort and to the objective of forming a good seal of the respirator against the face. Additionally, complicated pleating, stitching, riveting and other assembly procedures needed to produce prior art folded respirators render them relatively difficult and costly to produce.

Further, there exists a need in the art for a comfortable, disposable respirator having the ability to absorb toxic gases and vapors. Heretofore, relatively bulky respirators carrying a cartridge of some type have been employed for this purpose.

In view of the foregoing, an objective of the present invention is to provide improvements in fold-flat type respirators and method of making same.

Another object is to provide for simple and economical mass production of the respirators, more particularly by use of a continuous multi-ply layered web of disposable materials.

Still another object is to provide an end product offering exceptional face-fitting and breathing comfort with optimum air filtering efficiency.

Yet another object of the present invention is to provide a comfortable, fold-flat, disposable respirator having the capability of absorbing a toxic gas or vapor.

Other objects and advantages of the invention will become apparent from the following description when taken in conjunction with the accompanying drawings.

IN THE DRAWINGS

DESCRIPTION OF THE PREFERRED EMBODIMENTS

Figure 3:
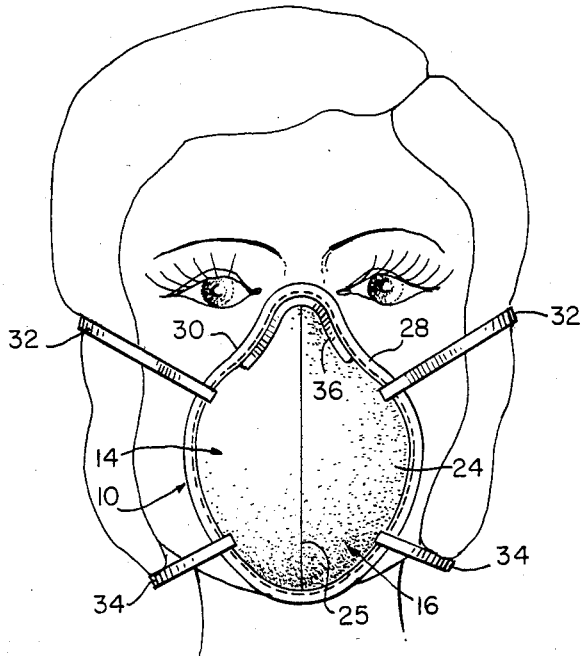
FIG. 3 is a front elevational view of the respirator of FIG. 1 shown in a position of use.
Figure 4:
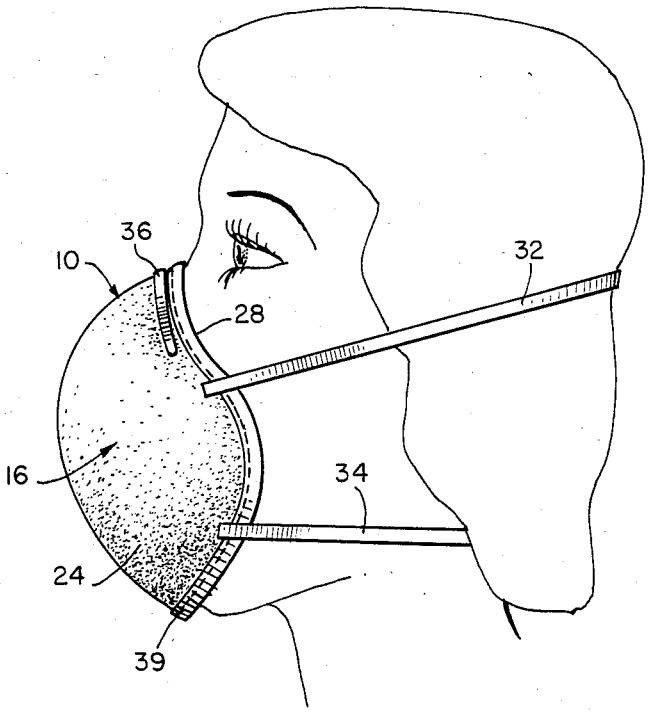
FIG. 4 is a side view of the respirator of FIGS. 1, 2 and 3 also shown in a position of use.

Referring to the drawings, respirator 10 (FIG. 1) is shown folded flat for convenience of packaging, shipping and/or carrying in a worker's pocket as a spare or when not needed on the face. In FIGS. 3 and 4, respirator 10 is opened and illustrated in a position of use.

The respirator 10 comprises right and left webs 14 and 16, of layered air-filtering and absorbing materials, joined together at a vertical seam 25 running from the bridge of the user's nose toward the user's chin. Each web preferably includes an inner scrim 18, an aerosol filter layer 20, a toxic gas or vapor absorbing layer 22 and an outer protective layer 24. The four layers constituting right web 14 and the four layers constituting left web 16 are die cut to shape with cut-out contoured edges 28 and 30 provided for conforming to the mating facial contours. For assembly, the four plies 18, 20, 22 and 24 constituting left web 14 and superimposed on the four layers 18, 20, 22 and 24 constituting left web 16 in the manner depicted together in FIG. 2. The vertical seam 25 is then formed by stitching together the two webs at edges opposite 28 and 30, e.g., with a nylon thread. A foam rubber strip 38 having a pressure sensitive adhesive layer is folded over the vertical seam 25 and pressed into place. The whole assembly is then turned inside-out and the edges 28 and 30 are separately stitched together with a binder strip 39 folded over same. The binder strip 39 may be, for example, a woven polyester/cotton blend, although almost any type of binder strip will suffice and may optionally be dispensed with entirely.

Almost any flexible or elastomeric foam material may be used as stip 38. One such suitable foam material is a polyurethane/polyester blend available from Rogers Foam Corp., Sommerville, Mass. (Catalog No. RFI-261-100PPI-ZWHITE) which, as sold, has a pressure sensitive adhesive layer. The foam strip serves the dual purpose of preventing the inturned vertical seam 25 from rubbing the face and providing an enhanced seal at the bridge of the nose and the chin.

The outer protective layer 24 requires a material capable of withstanding direct handling abuses but having a porosity permitting easy passage of inhaled and exhaled air. Nonwoven or woven fabrics may be used. A nonwoven mesh of polyester fibers with a heat-sealable binder of polyvinyl chloride may be used, such as is commercially available from the New Milford Nonwoven Corp. (Catalog No. C-310, a calandered material on the order of 0.010" in thickness. The primary functions of layer 24 are protection (encapsulation) of the absorbing layer 22 and structural support for the body of the respirator. Layer 24 is also color coded to indicate the type of service intended, e.g., blue for HF.

The toxic gas and vapor absorbing layer 22 is uncalandered and is in a lofty state as compared to layer 24. Layer 24 consists of a nonwoven fabric (for example) which serves as a carrier for a toxic gas or vapor absorbent or neutralizing agent. For example, in respirators intended for service in the aluminum smelting industry where hydrogen fluoride (HF) fumes pose a problem, the layer 22 may be a nonwoven batt impregnated with calcium carbonate. Such a calcium carbonate impregnated batt is commercially available from Lewcott Chemical & Plastics Co. (Catalog No. CA-OA1325-0.075-2.5-125). The nonwoven batt carrier of that commercial product is a 100% polyester fiber batt with an acrylic binder (0.075" thick). The carrier layer 22 could, for other services, be impregnated with activated carbon, or another absorbent, fire protecting agent or neutralizing agent.

Inner aerosol filter medium 20 is also preferably maintained in a somewhat lofty state, e.g., uncalandered and having a significantly higher loft than layer 24 between lines of edge stitching, may comprise a random gathering of polyester fibers with a thermoplastic medium. A suitable commercial product is a melt-blown 100% polyester fiber nonwoven fabric uncalendered fabric available from the James River Corp., Riegel Products Division, under the trademark "POLYWEB" (0.028" thick). However, any material meeting the NIOSH requirements for penetration and breathing resistance, as set forth at 30 CFR 11(k), may be used as filter layer 20.

The sequence of layers is important. The absorbing layer 22 is loftier than filter layer 20 and serves as a prefilter for layer 20. Accordingly, layer 22 should be positioned on the exterior side of layer 20 as shown in the drawing figures. With such an arrangement more permeability is retained during service, as compared with a structure wherein the relative positions of layers 22 and 20 are reversed, and the useful service life is prolonged.

Scrim 18 which engages the face when worn may comprise a soft highly porous web or mesh of polypropylene. A sutiable commercially available product is SNOWPRO Style #440-0827 polypropylene filter media 0.8 oz/sq. yd. supplied by Snow Filtration Company of Cincinnati, Ohio, U.S.A.

The preferred embodiment diclosed herein provides protection against HF fumes, silica dust and silica mist.

It should be understood that in the combination of materials selected for plies 18, 20, 22 and 24 one or more of those plies may be an open-celled flexible foam, rather than a fabric.

It should be understood that while the above mentioned materials and sources of supply will provide for successful practice of the invention, this information is not to be taken as limitive or in any sense restrictive to the invention. Those skilled in the art will readily appreciate that various other commercially available or specially prepared synthetic and/or natural fiber mediums, webs, meshes, shells or scrims may be obtained or produced and used.

Figure 1:
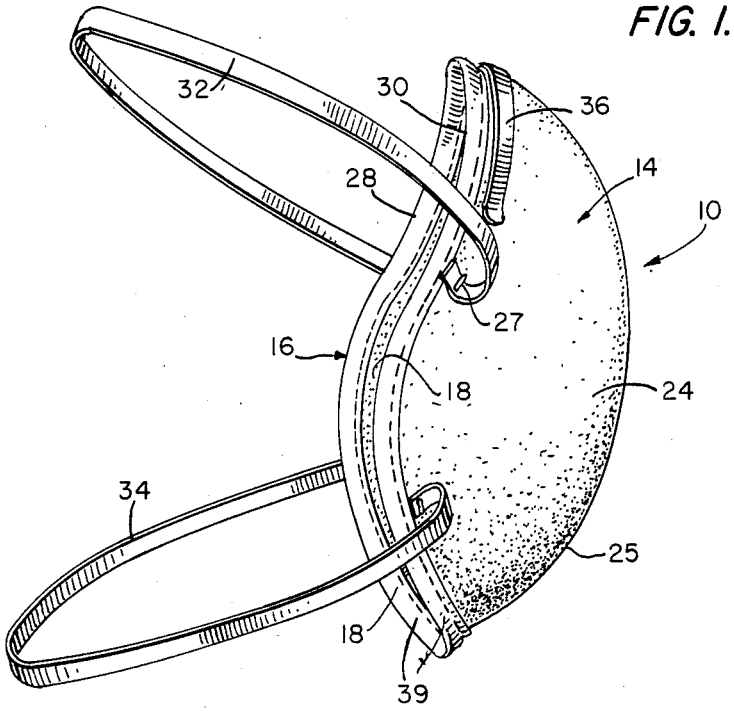
FIG. 1 is an illustration, in perspective, of a preferred embodiment of the respirator of the invention, folded approximately flat for carrying.

Referring more particularly to the shape of respirator 10, it can be seen from FIGS. 1, 3 and 4 that special curvilinear edge contours 28 and 30 have been selected to provide a comfortable substantially airtight seal about the nose and mouth when respirator 10 is positioned for wearing and held by elastic headbands 32, 34. Headbands 32 and 34 are attached to the respirator by staples 27 to provide a connection which will hold in high temperatures, e.g., temperatures on the order of 140° F. found inside aluminum smelting plants.

An attached malleable chevron 36 facilitates fitting and maintaining fit of the respirator over the nose. The chevron may be formed of a strip of aluminum or its equivalent and cemented in place, straddling the vertical seam 25 which approximately bisects same.

By pressing the chevron toward the nose after application of the respirator the aforesaid nasal sealing may be readily accomplished. While the nose area is usually considered the most difficult to fit and seal it can be readily attended to in this manner, with the chevron 36 acting in concert with the foam strip 38.

As illustrated in FIGS. 3 and 4, respirator 10 may be quickly and efficiently converted from its folded, pocket carrying configuration for wearing by opening edges 28 and 30, placing the opening over the nose, mouth and chin, slipping headbands 32, 34 over the head and shaping chevron 36 against the nose.

Figure 2:
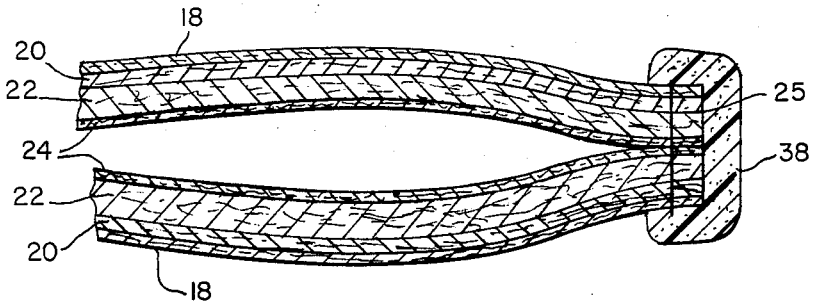
FIG. 2 is an enlarged, fragmentary sectional view of the respirator of FIG. 1, turned inside out.
Figure 5:
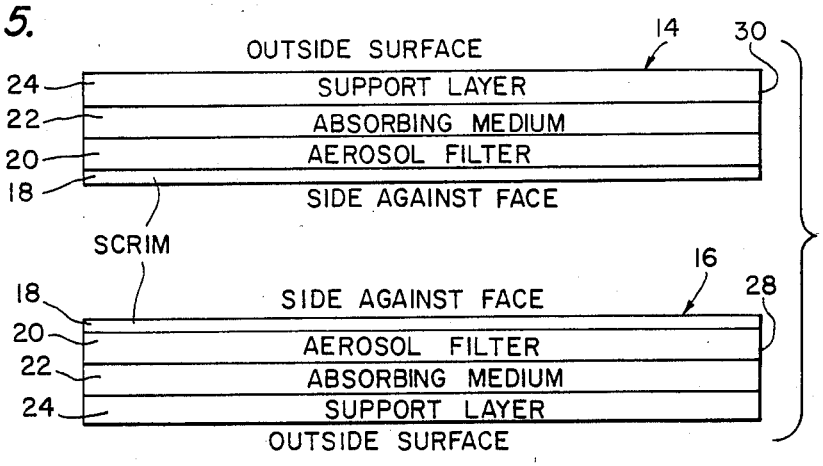
FIG. 5 is a diagrammatic illustration of a cross-section of a materials assembly used in practice of the invention.

In FIG. 5, a schematic of layered materials illustrates, in cross-section, the final orientation of materials used in webs 14 and 16 of respirators according to the invention. In fabrication, the plies constituting the right side of the mask are die cut to shape and are superimposed on the plies constituting the left side of the mask in reverse of the sequence shown in FIG. 5, i.e., with support layers 15 in a facing relationship as shown in FIG. 2. The edges of all eight plies are then stitched together to form the vertical seam 25 and foam strip 39 is attached. The whole body of the respirator is then turned inside-out and edges 28 and 30 are then each separately wrapped with a binder material 38 and individually stitched through the binder strip.

The vertical seam of the respirator described herein has been found to be significantly superior to fold-flat respirators having horizontal seams, as exemplified by that disclosed in U.K. Pat. No. 1,588,442, in terms of its ability to conform to the contours of the user's face. That advantage, in turn, provides a superior seal with the face and superior comfort.

Those skilled in the art will readily appreciate that there are various other modifications and adaptations of the precise forms of the invention here shown which may suit particular requirements. Accordingly, the foregoing illustrations are not to be interpreted as restrictive of the invention beyond that necessitated by the following claims.

We claim:

1. A fold-flat, disposable respirator comprising:

a pair of multiple layered webs of flexible air-permeable materials, each web comprising a layer of an aerosol filtering material and a layer of a toxic gas absorbing material, said webs each having one curvilinear edge portion for mating with facial contours and said webs being joined together at a common seam which is vertical as worn, the web edges forming said vertical seam being located on the interior of said respirator and being covered with a strip of an elastomeric foam coextensive with the length of said seam; and means for holding said respirator open against a wearer's face.

2. The respirator of claim 1 wherein said filtering material layer and said absorbing material layer both comprise a lofty, fibrous, non-woven fabric.

3. The respirator of claim 1 wherein each of said webs comprises:

an inner, soft fabric liner for contact with the face;

an intermediate layer of a fibrous batt impregnated with a solid, particulate absorbent for toxic gas;

an outer covering layer serving to protect said intermediate layers.

4. The respirator of claim 1 further comprising a strip of deformable material spanning said vertical seam, which strip may be bent to conform to the shape of the bridge of the wearer's nose.

5. The respirator of claim 4 wherein said strip is in the configuration of a chevron.

6. The respirator of claim 4 wherein said strip is a ductile metallic material.

7. The respirator of claim 1 wherein said toxic gas absorbing material is on the exterior side of said aerosol filtering material.

* * * * *